US006029673A

United States Patent [19]

Jenkins et al.

[11] Patent Number: 6,029,673

[45] Date of Patent: Feb. 29, 2000

[54] METHOD AND APPARATUS FOR CREATING ART ON A PERSON'S FINGERNAIL OR TOENAIL

[75] Inventors: Nevin C. Jenkins, Homosassa; Rande W. Newberry, Palm Harbor; Antonio Lebron, Spring Hill, all of Fla.

[73] Assignee: Fashion Nails, Inc., Homosassa, Fla.

[21] Appl. No.: 09/283,969

[22] Filed: Apr. 2, 1999

Related U.S. Application Data

[63] Continuation-in-part of application No. 09/030,947, Feb. 26, 1998, Pat. No. 5,960,798.

[51] Int. Cl.[7] ..... A45D 29/00

[52] U.S. Cl. ..... 132/73

[58] Field of Search ..... 132/73, 285; 101/33, 101/41, 163, 166, 193, DIG. 40

[56] References Cited

U.S. PATENT DOCUMENTS

| | | |
|---|---|---|
| Re. 14,619 | 3/1919 | Moeller . |
| 310,784 | 1/1885 | Bollinger . |
| 1,594,431 | 8/1926 | Thomson . |
| 1,728,512 | 9/1929 | Sharp . |
| 2,031,225 | 2/1936 | O'Donnell . |
| 2,180,519 | 11/1939 | Hamilton et al. . |
| 2,220,758 | 11/1940 | Florio . |
| 2,245,929 | 6/1941 | Mangold . |
| 2,246,729 | 6/1941 | Gutberlet . |
| 2,262,977 | 11/1941 | Vasil . |
| 2,287,062 | 6/1942 | Powers et al. . |
| 2,296,795 | 9/1942 | Landsman . |
| 2,454,004 | 11/1948 | Pettyjohn . |
| 2,485,384 | 10/1949 | Klein . |
| 2,519,335 | 8/1950 | Ballou et al. . |
| 2,524,322 | 10/1950 | Lipnicki et al. . |
| 2,580,893 | 1/1952 | Dee . |
| 2,701,520 | 2/1955 | Rider . |
| 2,735,435 | 2/1956 | Feinstein . |
| 2,799,282 | 7/1957 | Slack . |
| 2,842,046 | 7/1958 | Murray . |
| 3,070,906 | 1/1963 | Tinsley . |
| 3,094,920 | 6/1963 | Priesmeyer . |
| 3,164,259 | 1/1965 | De'Caccia . |
| 3,461,885 | 8/1969 | Coveney . |
| 3,480,020 | 11/1969 | Ernest . |
| 3,515,154 | 6/1970 | Morgese . |
| 3,598,685 | 8/1971 | Lee et al. . |
| 3,898,357 | 8/1975 | Miller et al. . |
| 3,916,784 | 11/1975 | Dubuit . |
| 4,019,436 | 4/1977 | Handweiler et al. . |
| 4,060,031 | 11/1977 | Philipp . |
| 4,314,504 | 2/1982 | Combeau . |
| 4,508,032 | 4/1985 | Philipp . |
| 4,738,199 | 4/1988 | Chen . |
| 4,803,922 | 2/1989 | Dennesen . |
| 4,915,239 | 4/1990 | Persch . |
| 4,968,253 | 11/1990 | Thomas . |
| 5,090,320 | 2/1992 | Nave . |
| 5,133,369 | 7/1992 | Billings . |
| 5,151,386 | 9/1992 | Bottari et al. . |
| 5,269,330 | 12/1993 | Hayes . |
| 5,277,205 | 1/1994 | Jenkins . |
| 5,302,224 | 4/1994 | Jenkins et al. . |
| 5,316,026 | 5/1994 | Jenkins . |
| 5,743,180 | 4/1998 | Arnke . |

*Primary Examiner*—Todd E. Manahan
*Attorney, Agent, or Firm*—Evenson, McKeown, Edwards & Lenahan, P.L.L.C.

[57] ABSTRACT

A self-hand-operated, self-contained apparatus and method for applying an image on a nail of a person's digit. The apparatus is simple in construction and operation, and consists of a molded base having an upper extending surface defining a digit cutout at one end and an image creating plate cutout at the other end. A carriage holding a pick-up head and squeegee slides on the base and carries an image from the plate to the nail. A combined stop and pointing element is fixed on the base and points to the area where the image is to be deposited. The method applies art to the nail as a single color or multi-color image.

20 Claims, 8 Drawing Sheets

METHOD AND APPARATUS FOR CREATING ART ON A PERSON'S FINGERNAIL OR TOENAIL

RELATED APPLICATIONS

This application relates to U.S. applications Ser. No. 09/056,635, filed Apr. 8, 1998 pending; Ser. No. 09/076,790, filed May 13, 1998 pending, and Ser. No. 09/129,390, filed Aug. 5, 1998 pending, and is a continuation-in-part of U.S. application Ser. No. 09/030,947, filed Feb. 26, 1998 now U.S. Pat. No. 5,960,798.

FIELD OF INVENTION

The present invention relates a method and hand operated apparatus for creating an art image on a person's fingernail or toenail.

BACKGROUND OF THE INVENTION (a) Prior Art

The desirability of creating art images on a person's fingernails and toenails is widely recognized and practiced. Known techniques include transfers, decals, appliques and hand painting. Recently, U.S. Pat. Nos. 5,277,205; 5,302,224; and 5,316,026 have been granted regarding novel techniques for creating images on nails. Newly developed technology, based on the foregoing patents and the related applications noted above, works well in principle, and has been incorporated into professional models of machines for use by professional nail technicians, including the developed technology where complex multicolor images can be created consistently and repeatably with excellent registration and detail. However, there remains a need to develop an apparatus that embodies the developed technology, but can be made inexpensively so that machines can be manufactured that can be sold to consumers for home use.

(b) Summary of Invention

Therefore, the principal object of the present invention is to provide a method and apparatus for effectively creating nail art on a person's fingernail, and to do so to accomplish the noted purposes. To this end, the invention provides hand-operated apparatus that can be manufactured inexpensively, efficiently and readily, and that will be of rugged construction and will function effectively, smoothly and repeatedly, and will be suitable for sale to consumers for use in the home.

Accordingly, the present invention achieves the principal object of the invention by a method for applying an art image on a person's nail that comprises the step of providing a machine that is molded from the minimum of parts that includes a novel reference and orientation system for establishing a reference point. At one end of the base of the machine a person's finger is positioned in a V-shaped groove with the free end of the digit bearing against an orientation surface with the person's fingernail overlying a second orientation surface located relative to a reference point. At the opposite end of the base of the machine an image composed of an image defining coating material is created using an engraved plate. The created image is created and picked up from the opposite end by a transfer member movably mounted on the supporting base, transferred over the surface of the supporting base to the person's nail at the first end of the base, and deposited onto the person's nail at a position on the nail correlated with the reference point.

In the method the picked up image may be transferred by a linear motion. Also, the depositing of the picked up image may be effected by a linear motion. Further, the transfer of the picked up image may be effected with guiding. The step of creating the image may include the steps of depositing coating material onto the plate and doctoring excess coating material in the creation of the image. The method steps can be repeated a multiple of times with repositioning of the plate between successive times. The method can further include a step of positively stopping the picked up created image in proper orientation to the person's nail during transfer, and the stopping can be adjustable. The method can be carried out to create a multi-color image.

The present invention additionally contemplates a self-hand operated self-contained apparatus for applying an image on a person's nail comprising a base having opposite ends and an upper extending surface defining a first cutout at one end of the base, an element for establishing a reference point, an image creating plate received in said first cutout for creating thereon an image composed of an image defining coating material, a digit positioning member at the other end of the base having a V-shaped groove for receiving and positioning a person's digit relative to the location of the created image, an orientation surface defined by the base against which the free end of the person's digit bears and the person's nail overlies to establish, in cooperation with the V-shaped groove, the appropriate orientation relative to the reference point and a transfer member mounted on said base movable over the upper surface for transferring the created image from the image creating plate to the person's nail.

The apparatus may further be characterized in that the transfer member includes a squeegee for removing excess coating material from an image and a pick up pad for picking up a created image. The apparatus can further include guide elements to guide the transfer member during movement, and the guiding can be linear. In the apparatus the squeegee and the pick up pad may be mounted in common, with the pad mounted for vertical movement. The apparatus may further comprise an adjustable stop serving as the reference point for indexing the pick up pad relative to the person's nail.

Other objects and advantages of the present invention will become readily apparent from the following.

BRIEF DESCRIPTION TO THE DRAWINGS

FIG. 1 is a perspective view of the molded base of the apparatus of the present invention.

FIG. 1*a* is a plan view of the bottom of the base shown in FIG. 1.

FIG. 1*b* is a perspective showing the assembly of the base and the transfer carriage.

DESCRIPTION OF PREFERRED EMBODIMENT

Figure 1:
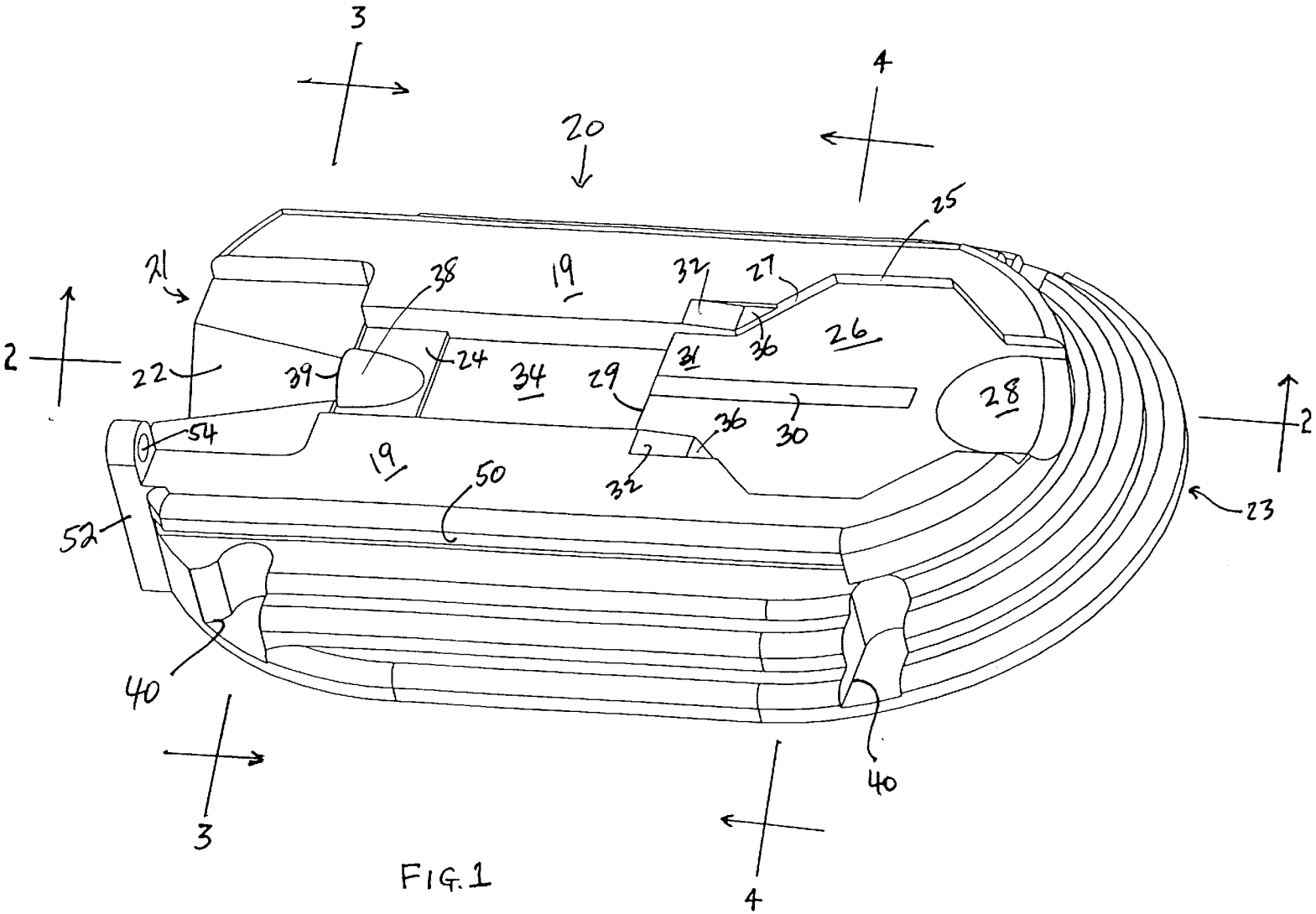

Referring now to the drawings in detail, a preferred embodiment of the apparatus of the present invention, as shown in the drawings, will be described. The self-operated machine essentially consists of six parts, namely, a base, a carriage, a transfer head, a squeegee, a reference pointer and a stop element. As will become more evident from the following description an engraved plate is used in conjunction with the machine.

The base 20 of the self operated machine is shown in FIGS. 1 to 4, and consists of an integrally molded hard plastic body that is elongated and has opposite ends 21 and 23. Base 20 has an upper surface 19. At one end, the body is cutout at 22 to define a V-shaped groove or slot that slopes from the end upwardly terminating at a transverse wall 24. At the other end of the base is a cutout 26 that is octagonal in shape with successive sides of the octagon being different in length for a reason that will become evident in the following description. Thus, the octagon is comprised of two sets of sides 25 and 27 of differing length. At the end of the cutout 26 is a depression 28 for insertion of a finger, as will be explained further on. The center of the cutout 26 has a raised rib 30, raised about 3 to 6 mils from the floor of the cutout 26, that extends along the medial line of the base from a point spaced forward from the finger depression 28 to the forward end 29 of the cutout 26, or to the left as viewed in FIG. 1. At the extreme forward end 29 of the cutout 26, the base is cut entirely through to define a rectangular hole 34. Cutout 26 extends beyond the octagonal shape at its forward end portion 31. Adjacent portion 31, the upper surface 19 is cutout to form ramps 32 on either side. Between the bottom edge of ramps 32 and cutout 26 are triangular portions 36 raised above cutout 26 by the thickness of a plate to be received in the cutout 26.

At the forward end of the hole 34 is a wall or crossbar 24 having formed thereon a raised hump or projection 38 in a shape that tapers downwardly as it progresses to the rear, or right as viewed in FIG. 1. The forward end 39 of the projection 38 is vertical and extends transverse to the long direction of the base, and serves as an orientation surface for the end of the finger which is positioned in the upwardly sloping V-shaped groove 22 with the fingernail overlying the upper surface of projection 38.

Figure 1A:
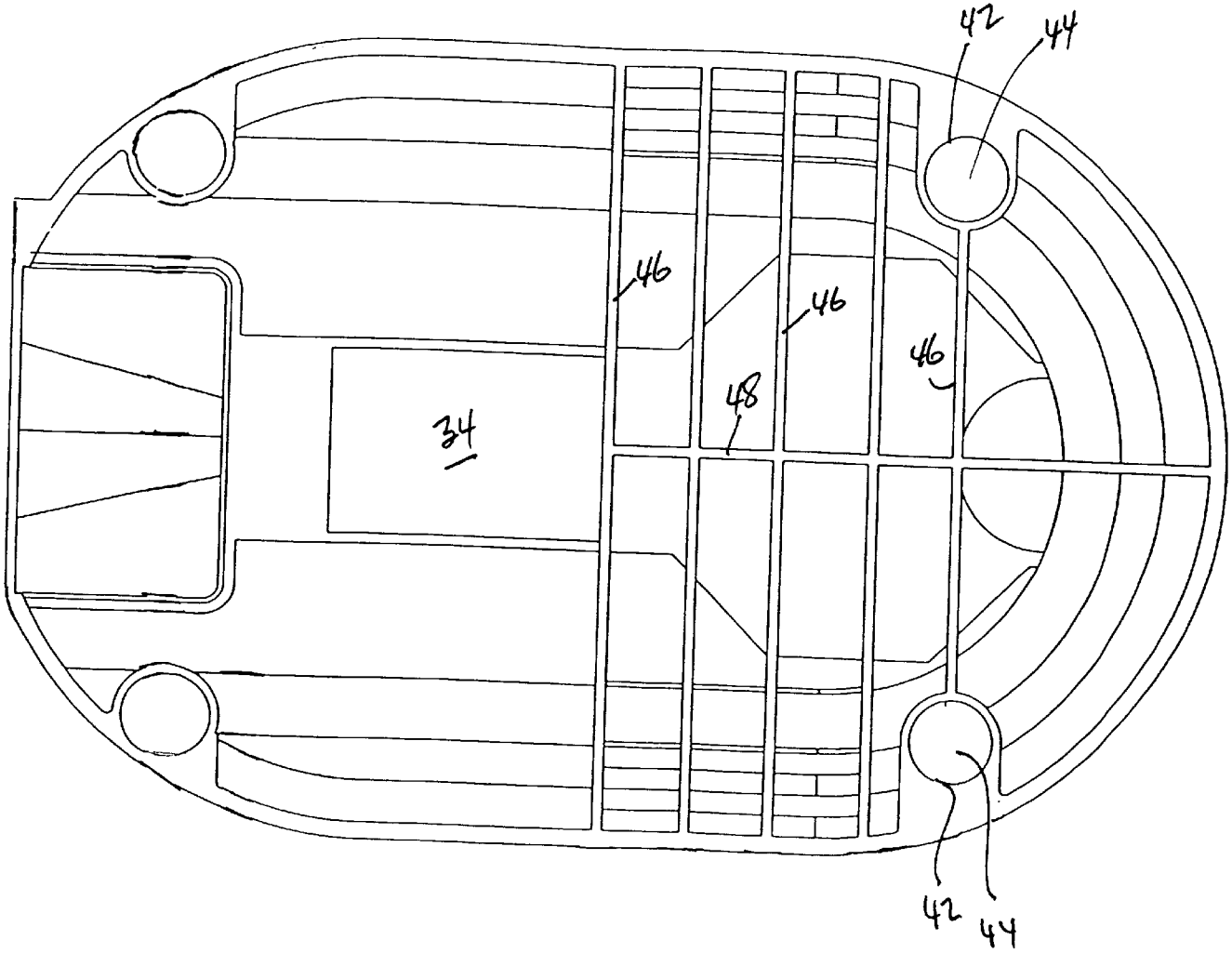

The sides of the base are vertically cutout at 40 at four locations, two at either end of the base. Underneath each cutout 40 in the bottom of the base, see FIG. 1*a*, recesses 42 are defined in the bottom of the base, and inset into each recess (using adhesive) is a rubber foot 44, see FIG. 3. In this fashion the base is supported on a suitable surface, such as a table top, on four rubber feet 44. Further, the area of the base underneath the octagonal cutout 26 is provided with five transverse reinforcing ribs 46 and one longitudinally extending reinforcing rib 48 that extends from the rear end to the forward-most rib 46, which is located beneath the forward end of the cutout 26 adjacent the hole 34. In place of using adhesive, a hole can be formed and tapped in each recess 42 and the rubber foot can be provided with a through hole. A screw passing through the foot can be threaded into the tapped hole to provide positive mechanical attachment of the rubber foot.

The sides of the base are also cutout or formed with horizontal guide or slide slots 50, one on each side just below the top of the side. Slots 50 extend from just forward of the vertical cutouts 40 to the forward end of the base. At the forward end of the base, a post 52 is fixed to base 20 and extends upwardly adjacent the V-shaped groove 22. Post 52 closes the forward end of the slot 50 on the side of the base that the post 52 is formed. The top of the post or bar 52 defines or is formed with a threaded through-hole 54 in the longitudinal direction of the base 20 parallel to the slot 50.

Figure 1B:
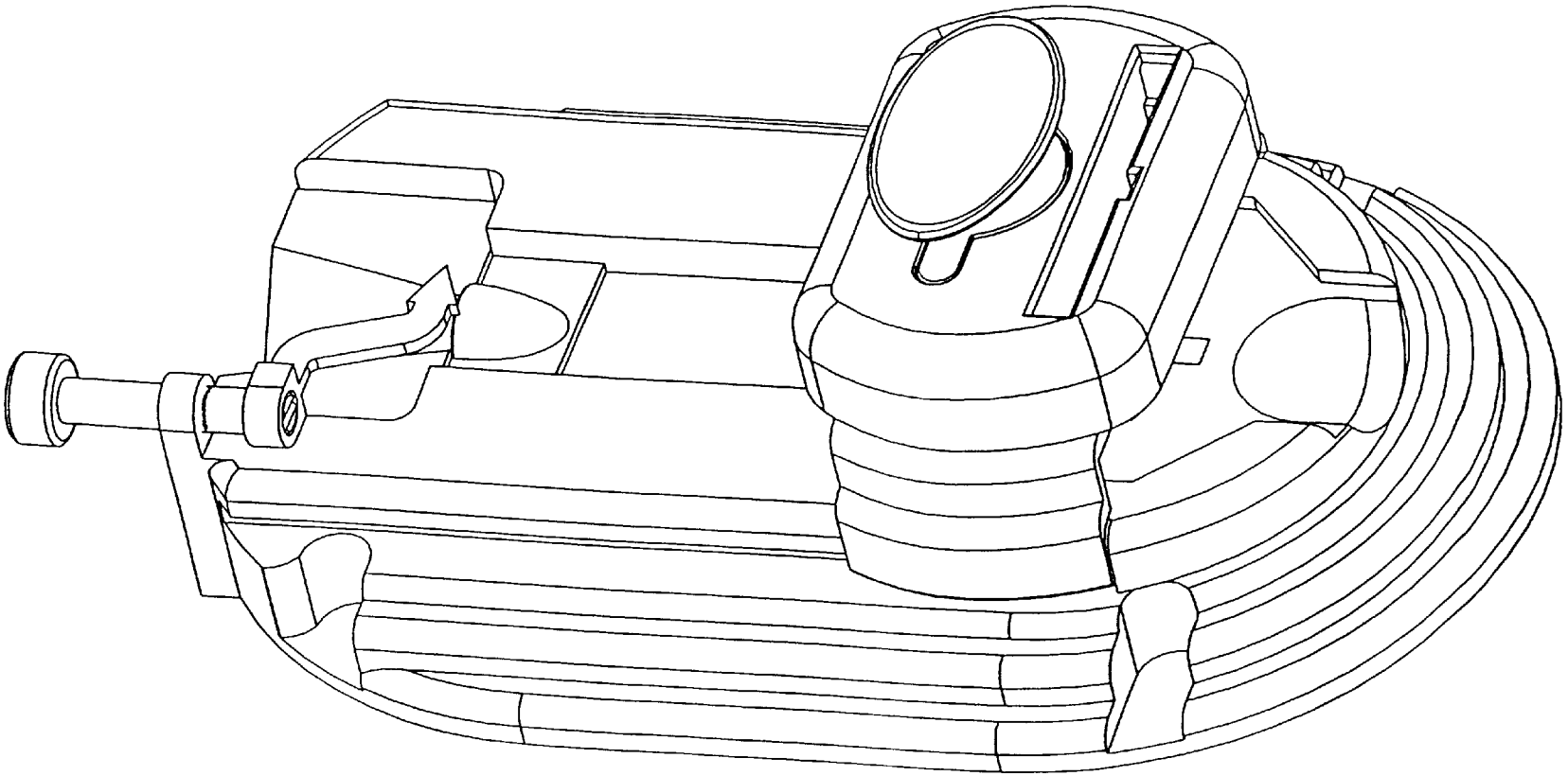
Figure 2:
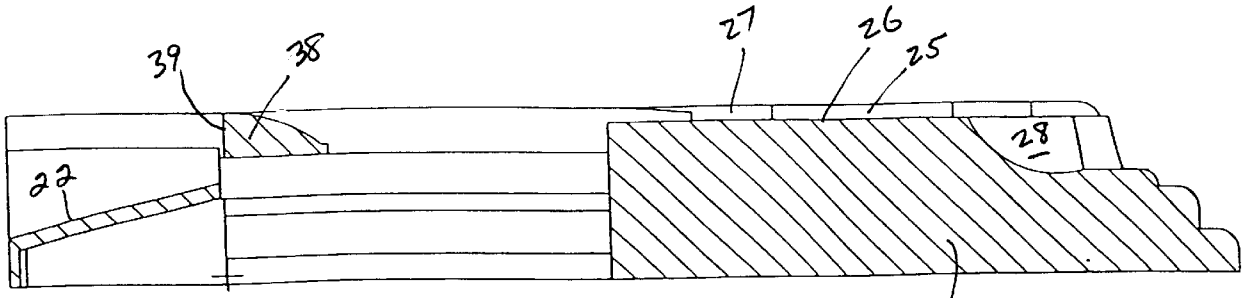
FIG. 2 is a sectional view of FIG. 1 taken along line 2—2.
Figure 3:
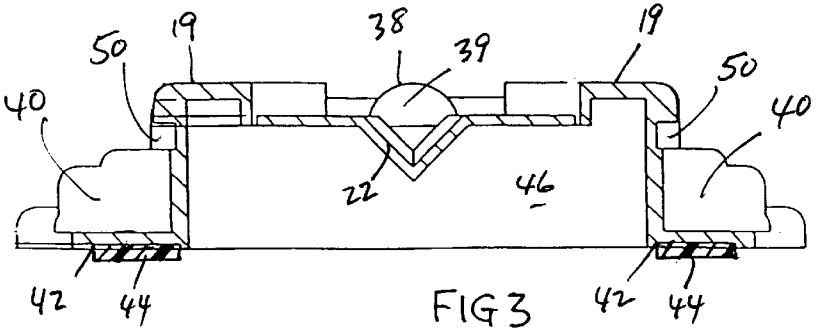
FIG. 3 is a sectional view of FIG. 1 taken along line 3—3.
Figure 4:
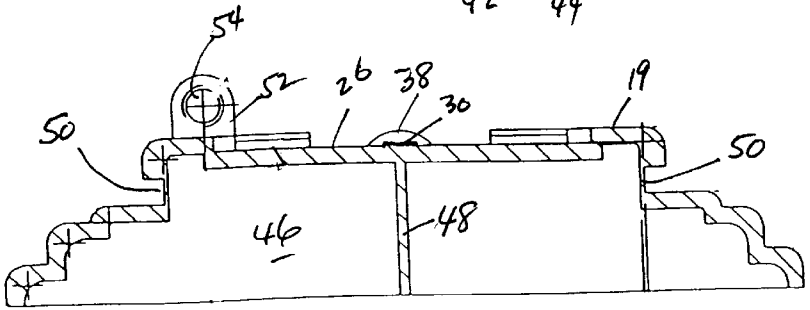
FIG. 4 is a sectional view of FIG. 1 taken along line 4—4.
Figure 5:
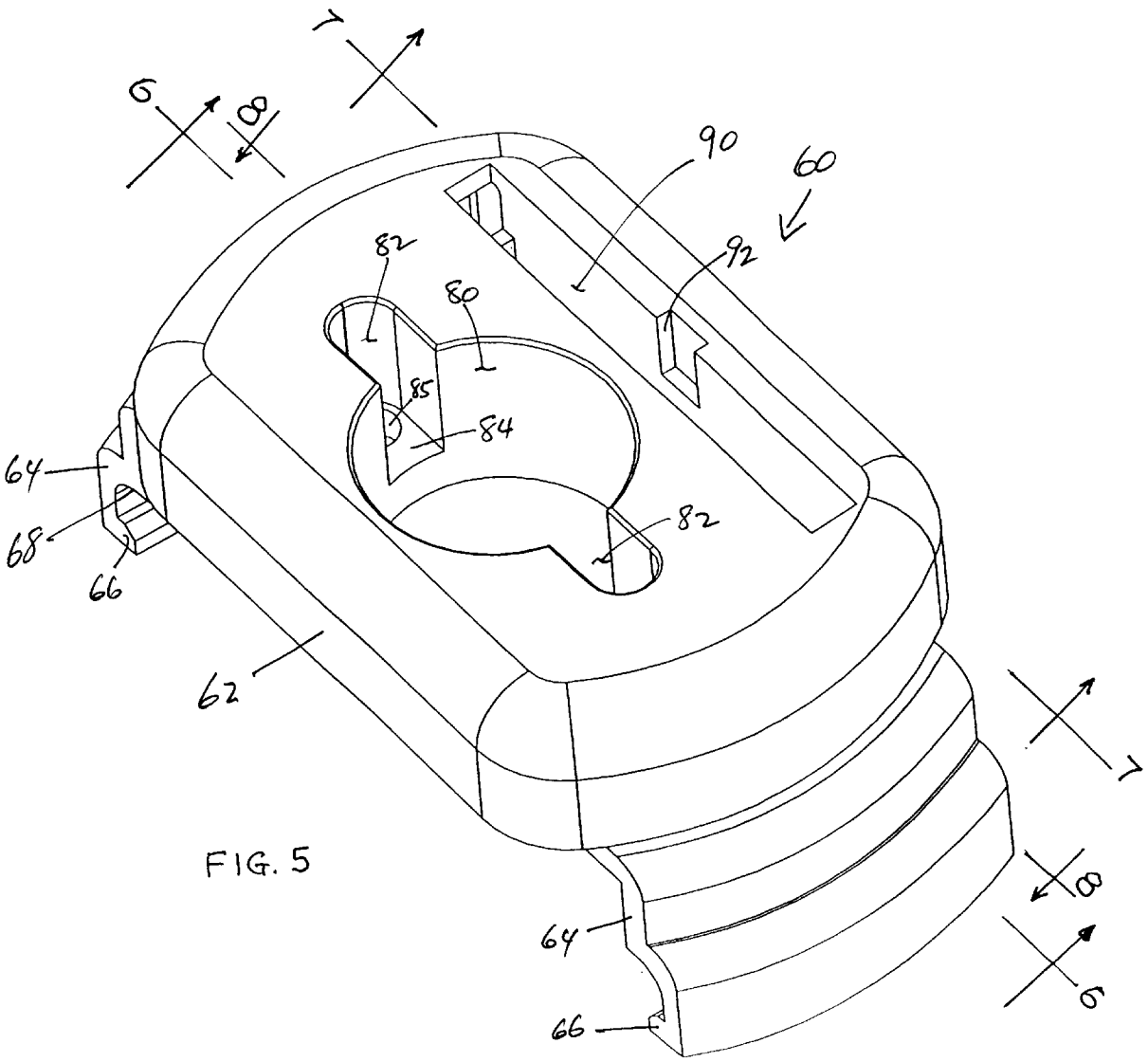
FIG. 5 is a perspective view of the carriage.
Figure 6:
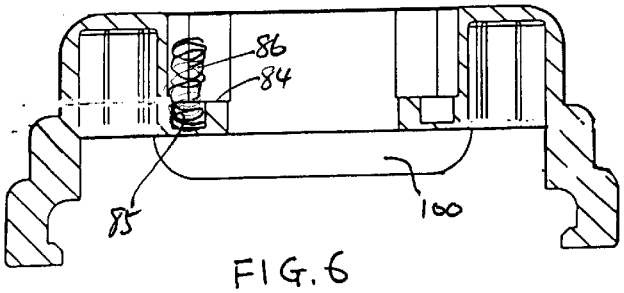
FIG. 6 is a sectional view of FIG. 5 taken along line 6—6.

Mounted on the base is a carriage 60 which is shown in FIGS. 5 to 8, and shown assembled to the base in FIG. 1*b*. Carriage is essentially U-shaped having a thickened central part 62 with two depending legs 64, one at each side of the central part 62. The legs 64 terminate at their free ends with inwardly projecting rails 66 that are received in the guide slots 50 so that the carriage can slide horizontally along the base 20 from one end to the other end. The mounted carriage is shown in FIG. 1*b*. Since the slots 50 are not free at their ends, the legs 64 are flexed to mount the carriage 60 on the base 20. The legs 64 are formed with shoulders 68 to ride on the top surface 19 of the base when the carriage is mounted on the base. The thickened central part of the carriage is formed with two through-holes 80 and 90. Through-hole 80 is essentially circular in cross-section and is provided with two wings 82 which are slots which do not penetrate completely the central part. The bottoms 84 of the slots 82 are formed with small circular recesses 85 for receiving coil springs 86, see FIG. 6, and holding them in a press fit so that they remain in position standing vertically.

The through-hole 90 is essentially rectangular in configuration extending transversely across the thick central part of the carriage. Through-hole 90 has a rear rectangular cutout 92, the purpose of which will become evident in the following. Also, the inner side walls 94 of the through-hole 90 are cutout at their upper part to form a shoulder 96 on each side, see FIG. 7. The rear wall 98 of the through-hole 90 extends downwardly below the main portion of the central part terminating in a transverse panel 100.

Figure 11:
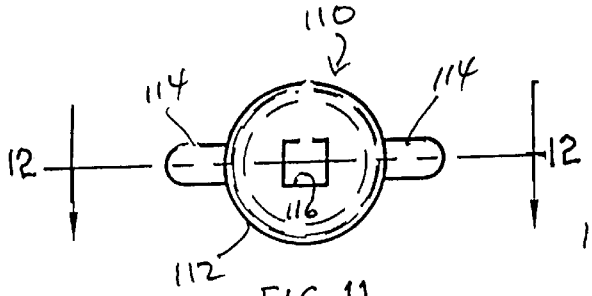
FIG. 11 is a top view of the transfer element.
Figure 12:
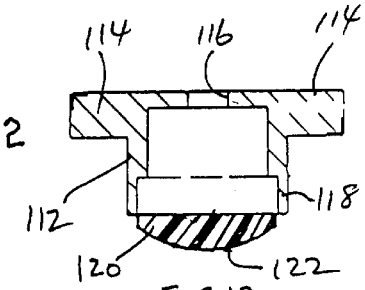
FIG. 12 is a sectional view of FIG. 11 taken along line 12—12.
Figure 13:
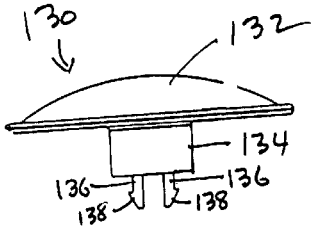
FIG. 13 is a side view of the pusher element that caps the transfer element.
Figure 14:
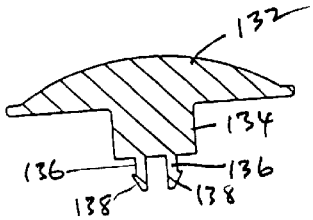
FIG. 14 is a mid-plane sectional view of the pusher element shown in FIG. 13.

A transfer element 110 is received in the through-hole 80 of the carriage and is shown in FIGS. 11 to 12. Transfer element 110 consists of a hollow cylindrical cap 112 which has two wings or projections 114 that are essentially rectangular in cross-section. The top of the cap 112 has a square through-hole 116. The lower end of the depending skirt 118 of the cap 112 is formed with an enlarged opening into which is press fitted a silicone or synthetic rubber pick-up head 120 presenting a rounded lower pick-up surface 122. An esthetic-appealing cover 130 covers the cap 112. The cover 130 is shown in FIGS. 13 and 14 and consists of a solid element 130 having an esthetically attractive dome oval top 132, a depending circular section 134 and two snap connectors 136 having latching tangs 138. The cover 130 is assembled to the transfer element 110 by inserting the two snap connectors 136 through the hole 116, during which movement the snap connectors flex together to pass through, and then flex apart so that the latching tangs 138 engage the underneath surface of the top of the cap 112. The transfer element 110 with the cover 130 assembled is put into the through-hole 80 with the pick-up head facing downwardly and the wings 114 resting on the upper ends of the springs 86. In this manner the cap 112 can be easily removed and replaced for cleaning, and when in operative position, is operated simply by depressing against the force of the coil springs 86 and releasing.

Figure 16:
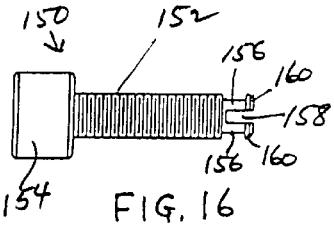
FIG. 16 is a mid-plane sectional view of the stop element shown in FIG. 15.
Figure 15:
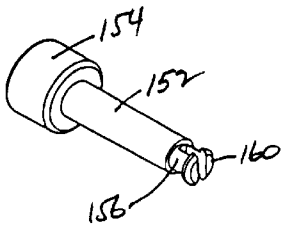
FIG. 15 is a perspective view of the stop element that cooperates with the reference pointer.

The stop or positioning element 150 is shown in detail in FIGS. 15 and 16 and consists of a threaded rod 152 having a cylindrical head 154 at one end. At the other end, rod 152 has axially projecting connectors 156 separated by a slot 158 with each connector 156 terminating with a radial projection 160. The diameter of the connectors 156 together is less than the threaded rod section 152 and the slot allows the connectors to be flexed together to bring the radial projections 160 together to allow them to pass through a hole as will be apparent hereinafter. Stop element 150 is threaded into hole 54 on post 52, see FIG. 1*b*, for positioning purposes.

Figure 17:
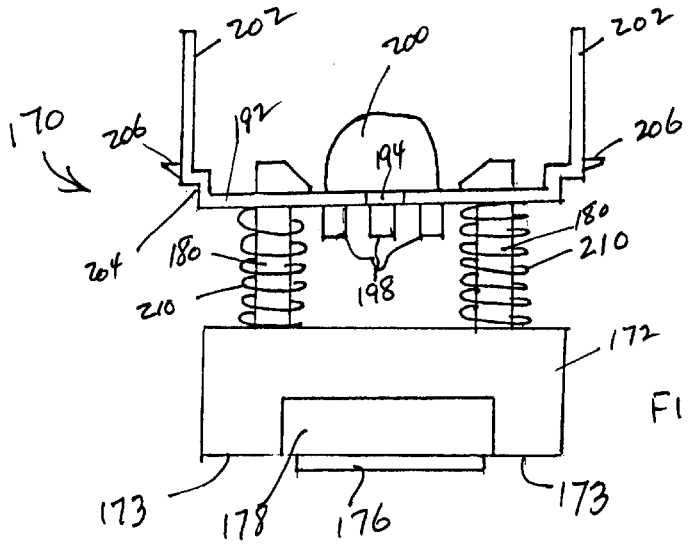
FIG. 17 is a side view showing a squeegee member.
Figure 19:
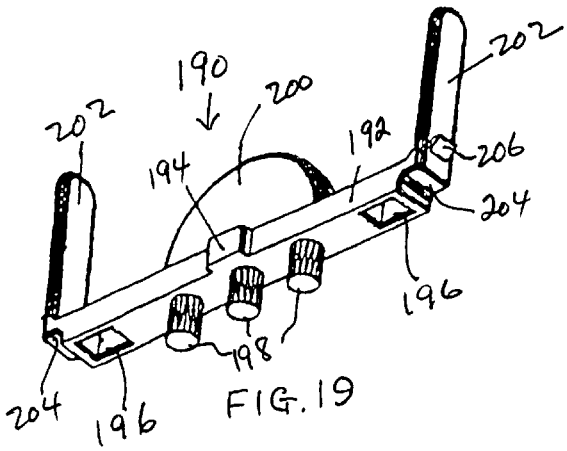
FIG. 19 is a perspective view of the top manipulated element of the squeegee member.
Figure 18:
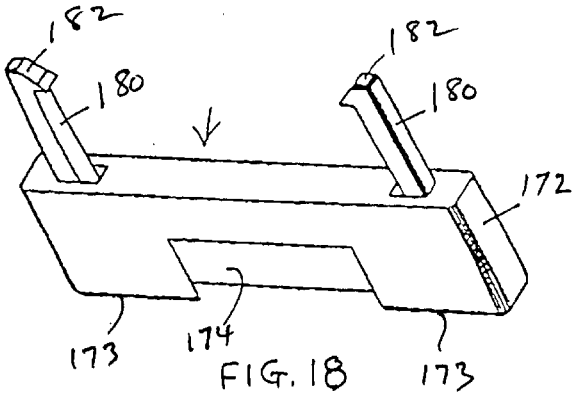
FIG. 18 is a perspective view showing the doctor blade holding element of the squeegee member.

The squeegee assembly or member 170 is shown in FIGS. 17 to 19 and consists of a doctor holding plate 172 having a cutout 174 to receive a doctor blade 176. The cutout 174 is undercut on the sides and receives a fixing plate 178 having beveled edges to fit tightly in the undercut sides of plate 172, and hold the doctor blade 176 securely in position with a small portion protruding as shown in FIG. 17. Plate 172 defines opposite lower edge portions 173 adjacent the projecting or protruding doctor blade 176. Plate 172 has two projecting posts 180 extending upwardly that have latching tangs 182 on their free ends. A securing element 190 is shown in FIG. 19 and consists of a main bar 192 having a central rectangular projection 194 and two rectangular through-holes 196, one at each end of the bar 192. Three cylindrical downward projections 198 extend from the bar 192 in a line. A central semi-circular pull tab 200 extends from the top of the bar 192. At each end of the bar 192, a vertical flexible rod 202 extends. The corner joint between the bar 192 and the rods 202 are cutout at 204. Projecting normally from the outer surface of each rod 202 is a latching tab 206 that is horizontal on top and tapered on the bottom. The plate 172 is assembled to the securing element 190 by inserting the posts 180 through the holes 196 whereupon the latching tangs 182 hold the parts together. Springs 210 are mounted on the posts 180 prior to assembly to provide a requisite spring or biasing force. A doctor blade 176 is inserted in the cutout in plate 172 and fixed in position by the interference fit of plate 178. The assembly is pictured in FIG. 17.

Figure 9:
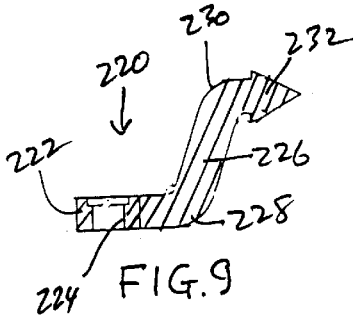
FIG. 9 is a sectional view of the reference pointer taken along its mid-plane.
Figure 7:
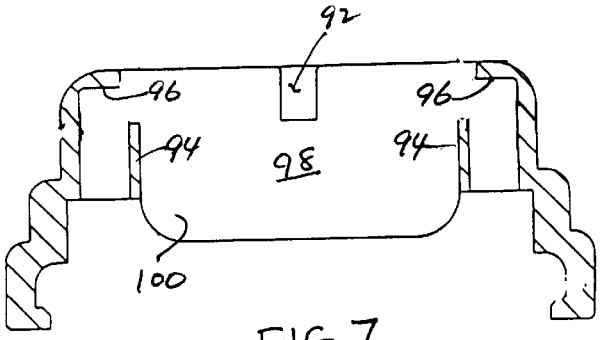
FIG. 7 is a sectional view of FIG. 5 taken along line 7—7.
Figure 10:
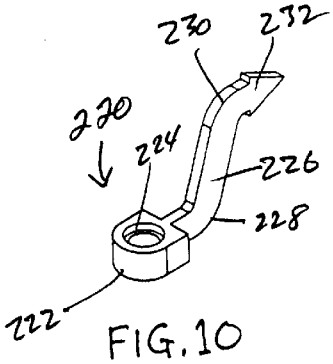
FIG. 10 is a perspective view of the reference pointer.
Figure 8:
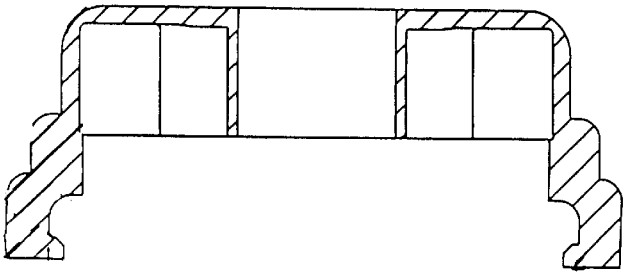
FIG. 8 is a sectional view of FIG. 5 taken along line 8—8.
Figure 20:
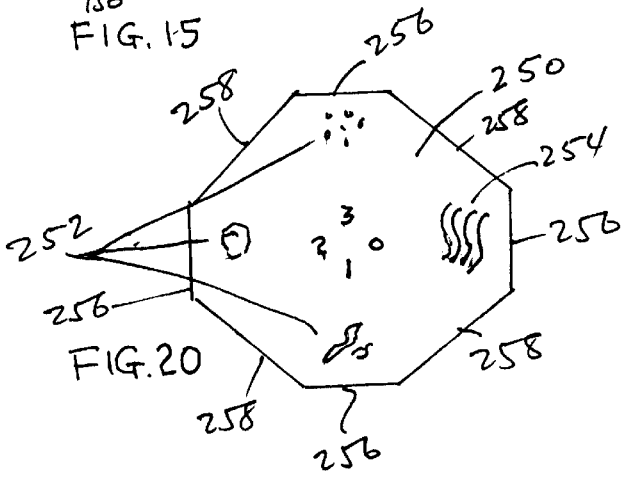
FIG. 20 is a top view of a plate used with the machine.

The reference pointer 220 is shown in FIGS. 9 and 10 and consists of a single piece having a hub 222 with a through-hole 224 of a size to interact with the stop. Extending from the hub 222 is a flat pointer portion 226 having a double bend at 228 and 230 and terminating in a pointing arrow shape 232. A typical plate 250 is shown in FIG. 20 and is designed to fit into the cutout 26 with its surface aligned or coextensive with the surface of the triangular parts 36, and its most forward side extending between the lower ends of ramps 32. The plate 250 is preferably made of stainless steel and engraved with images, or with partial images, if an image is composed of multi-color parts. Up to four color images can be created using the method and apparatus of the invention. As shown, the plate 250 contains engravings for a three color image 252 identified by the numerals "1", "2", and "3" engraved on the plate and a single color image 254 identified by the numeral "0" engraved on the plate. All these numerals are engraved about the center of the plate, and show the user the order in which to apply the image colors for multi-part, multi-color images. Thus, for the three part image, the images are applied in the order "1", "2", and "3". The color selection is usually represented to the user in a chart, but the user can select any colors of choice. As shown, the plate is octagonal in shape with adjacent sides 256 and 258 being of different length. Thus, there are four sides 256 of a length shorter than the four sides 258. The engraved images are located and oriented with respect to the short sides 256. The reason for this is to be certain that that plate is positioned correctly each time. It will be noted that the plate needs to be rotated 90 degrees for each new image. With plate 250 positioned in cutout 26, the operative image, i.e. the most-forward image is supported by the reinforcing raised rib 30 to prevent distortion of the plate due to the forces generated when the doctor blade 176 of the squeegee 170 is brought down onto the plate 250.

The invention is applicable to both fingernails and toenails. The following explanation of how the method of the invention is carried out, is made with reference to a fingernail, by way of example. The apparatus is assembled and positioned transversely to the user, facing left or right depending upon which hand the image is to be placed on, and the carriage is in the neutral position, i.e. the middle of the base 20 leaving the V-groove 22 and cutout 26 exposed. The assembly of the apparatus is shown in FIG. 1*b*. The stop or position setter 150 is threaded into the hole 54 in post 52 and the pointer element 220 is snapped onto the end of the stop 150. The stop 150 and the hub 222 of the pointer 220 combined are in an interference relationship with carriage 60. The transfer member 110 is positioned in the hole 80 with the wings 114 resting on the springs 86. The squeegee assembly is inserted into the hole or slot 90 with the projection 194 received in recess 92 for orientation. The pull tab 200 is pressed down until both latching tabs 206 latch under surfaces 94 and latch the squeegee assembly securely in position. Flexing of the rods 202 will allow removal of the squeegee for cleaning and replacement. The appropriate finger is positioned in the V-groove 22 with the end of the finger bearing against surface 39 and the fingernail overlying surface 38. The apparatus is oriented and referenced to the fingernail by manipulation of the combined stop element 150 carrying the pointing element 220 until the arrow 232 is pointing exactly at the place on or the area of the fingernail that it is desired to create an image. When this activity is completed, the stop element 150 is rotated half a turn to flip the flat bar 226 of the pointing element 220 180 degrees where it will be out of the way. A plate 250 is or has been appropriately positioned in the cutout 26, supported in a reinforcing way by rib 30. A color is selected and is coated onto the selected image (the most forward image). The free hand then grasps the carriage 60 and moves it backwards over the plate 250. Up to this time carriage 60 was in the neutral position, essentially over cutout 34 with the lower edge portions 173 of the plate 172 bearing on the upper surface 19 of the base 20, holding doctor blade 176 floating. In this manipulation, the squeegee is lowered down the ramps 32 by lower edge portions 173 sliding down ramps 32 whereupon the doctor blade 176 bears against the forward portion of plate 250 under the influence of the springs 210. As the squeegee is moved back, excess color is removed from the forward engraved image leaving the correct amount of color material remaining. When the squeegee has been moved back fully, i.e. rail 66 strikes the rear end of slot 50, the transfer member 110 is positioned correctly to pick-up the image. The transfer element 110 is then depressed downwardly against the springs 86 until the pick-up pad 120 engages the image and picks up the image. The transfer element is released, and the springs 86 return the transfer member 110 to its up position, whereupon, the carriage is moved in the forward direction until it encounters the combined stop 150 and hub 222 of pointer 220. At this point, the transfer member 110 is correctly positioned and is depressed to transfer the image to the fingernail in the selected area of or position on the nail. If the complete image is a multi-color, multi-part image, then the process is repeated after the plate has been repositioned (removed and rotated 90 degrees using finger depression 28) for the next part. As will be immediately evident, use of the apparatus and method of the present invention by a consumer can be effected easily and proficiently to obtain fine images of complexity with great detail.

Although the invention has been described in terms of a specific preferred embodiment, nevertheless, changes and modifications are possible that will be evident to a person skilled in the art. Such changes and modifications are deemed to come within the purview of the invention as recited in the appended claims.

What is claimed is:

1. A method for applying an art image on a person's nail comprising the steps of positioning a person's digit with the free end of the digit bearing against an orientation surface with the digit-nail overlying at least in part the orientation surface, selecting an area on the digit-nail upon which an image is to be deposited, manipulating a combined stop and reference pointer relative to the digit-nail so that the reference pointer points to the selected area on the digit-nail upon which an image is to be deposited, manipulating the combined stop and reference pointer to move the reference pointer away from the digit-nail, creating an image composed of an image defining coating material at a location remote from the digit-nail, picking up the created image from said remote location by a transfer member, transferring the transfer member and picked up image toward the person's digit until engaged by the combined stop and reference pointer, and depositing the picked up image from the transfer member onto the selected area of the person's digit-nail.

2. A method according to claim 1 wherein the picked up image is transferred by a linear motion.

3. A method according to claim 2 wherein creating the image includes the steps of depositing coating material onto a plate in the vicinity of where the image is created and doctoring excess coating material away from where the image is created.

4. A method according to claim 1 including the step of guiding the transfer of the picked up image.

5. A method according to claim 1 wherein the depositing of the picked up image is effected by a linear motion.

6. A method according to claim 1 wherein the steps are repeated a multiple of times with presentation of a different image each time to obtain a multi-part image on the person's nail.

7. A method according to claim 6 wherein a different color image defining coating material is used each time.

8. A method according to claim 1 wherein the reference point is detachably connected to the stop.

9. A method according to claim 1 wherein the transfer member is a carriage which provides the combined functions of pick-up and removing excess coating.

10. A method according to claim 1 further including a step of positively linearly guiding the transfer member relative to the position of the person's digit by a sliding motion.

11. Hand-operated self-contained apparatus for applying an image on a nail of a person's digit comprising:

an elongated base having an upper extending surface defining a first cutout at one end for receiving and positioning a person's digit and presenting the person's nail for deposit of an image, a second cutout at the other end for receiving an engraved plate for creating thereon an image composed of an image defining coating material, an orientation surface formed adjacent the first cutout, ramps formed adjacent the end of the second cutout nearest the first cutout, and at least one guide slot formed in the base, a combined stop and pointing member fixed to said base adjacent to the first cutout including an element that can be positioned longitudinally of the base and a pointing element for pointing to an image depositing area selected on a person's nail, and a transfer member for transferring a created image from an image creating plate to the selected area on the person's nail, said transfer member defining a guide rail and being mounted on said base with said guide rail received in said guide slot so that said transfer member is slidable over the upper surface of the base to contact said combined stop and pointing member.

12. Apparatus according to claim 11 wherein said transfer member includes a squeegee for removing excess coating material from an image and a pick-up pad for picking up a created image.

13. Apparatus according to claim 11 wherein a guide slot is formed on each side of the base and the transfer member is formed with a rail for being received in each guide slot.

14. Apparatus according to claim 11 wherein the first cutout is in the shape of a V-shaped groove.

15. Apparatus according to claim 11 wherein said transfer member includes a carriage that defines a through-hole in which are mounted springs, and a pick-up head is received in said through-hole resting on said springs.

16. Apparatus according to claim 15 wherein said carriage further defines a through-slot and a squeegee assembly is detachably received in said through-slot.

17. Apparatus according to claim 15 wherein means are provided to restrict placement of the squeegee assembly in the through-slot to one orientation only.

18. Apparatus according to claim 17 wherein the carriage includes a depending wall cooperating with the squeegee assembly.

19. Apparatus according to claim 17 wherein the squeegee assembly rides down said ramps to contact a plate located in said second cutout.

20. Apparatus according to claim 11 wherein said second cutout is octagonal in shape with adjacent sides being of different length.

* * * * *